US007201294B2

(12) United States Patent
Carlucci et al.

(10) Patent No.: US 7,201,294 B2
(45) Date of Patent: Apr. 10, 2007

(54) DISPENSING APPARATUS FOR RECEIVING A NUMBER OF DIFFERENTLY SIZED FOAM CANISTERS

(75) Inventors: Vito James Carlucci, Stratford, CT (US); Martin A. Cohen, Ridgefield, CT (US); Paul J. Carrubba, Baldwin, NY (US)

(73) Assignee: Conair Corporation, Stamford, CT (US)

( * ) Notice: Subject to any disclaimer, the term of this patent is extended or adjusted under 35 U.S.C. 154(b) by 594 days.

(21) Appl. No.: 10/811,322

(22) Filed: Mar. 26, 2004

(65) Prior Publication Data

US 2004/0226966 A1 Nov. 18, 2004

Related U.S. Application Data

(60) Provisional application No. 60/467,947, filed on May 5, 2003.

(51) Int. Cl.
*B67D 5/62* (2006.01)

(52) U.S. Cl. ..... 222/146.3; 222/146.2; 222/146.5; 222/402.13; 219/214

(58) Field of Classification Search ..... 222/146.3, 222/325, 146.2, 182, 146.5, 146.1, 402.13; 219/535, 214, 432
See application file for complete search history.

(56) References Cited

U.S. PATENT DOCUMENTS 3,207,369 A 9/1965 Rossi
3,358,885 A 12/1967 Flowers
3,476,293 A * 11/1969 Marcoux ..... 222/146.3
3,518,410 A 6/1970 Dillarstone
3,559,850 A 2/1971 Barkin et al.
3,576,279 A 4/1971 Ayres et al.
3,578,945 A 5/1971 Ayres et al.
3,593,894 A 7/1971 Kehoe et al.
3,596,056 A 7/1971 Dillarstone
3,644,707 A 2/1972 Costello
3,710,978 A 1/1973 Cosby
3,710,985 A 1/1973 Baum
3,712,512 A 1/1973 Snider, Jr. et al.
3,722,753 A 3/1973 Miles
3,733,460 A 5/1973 Ryckman, Jr.
3,749,880 A 7/1973 Meeks
3,752,155 A 8/1973 Blinoff, Jr. et al.
3,758,002 A 9/1973 Doyle et al.
3,790,003 A 2/1974 Ciaffone
3,804,537 A 4/1974 Pass
3,823,851 A 7/1974 Waters
3,843,022 A 10/1974 Radcliffe et al.
3,846,614 A 11/1974 Doyle et al.
3,891,827 A 6/1975 Wyse
3,896,973 A 7/1975 Morgan
3,914,576 A 10/1975 Ciaffone (Continued)

*Primary Examiner*—Frederick C. Nicolas
(74) *Attorney, Agent, or Firm*—Lawrence Cruz; Steven A. Garner

(57) ABSTRACT

A dispenser for heating a liquid in and dispensing a foam introduced from a canister. The dispenser has a heater for providing heat to the foam/liquid, a chamber with an inlet port and an outlet port and a base having an aperture and a first member. The chamber is in contact with the heater, and the outlet port is connected to a nozzle. The nozzle dispenses the heated foam. The dispenser also has a base adjoining. The first member is slidably retained over the aperture to adjust a size of the aperture and to receive a number of different diameter canisters.

24 Claims, 11 Drawing Sheets

U.S. PATENT DOCUMENTS

| | | | | |
|---|---|---|---|---|
| 3,917,121 | A | 11/1975 | Ciaffone | |
| 3,933,276 | A | 1/1976 | Packham et al. | |
| 3,990,612 | A | 11/1976 | Gasser | |
| 3,997,083 | A | 12/1976 | McNair | |
| 4,000,834 | A | 1/1977 | Whiley | |
| 4,024,987 | A | 5/1977 | Myles | |
| 4,027,786 | A | 6/1977 | Ryckman, Jr. | |
| 4,046,289 | A | 9/1977 | Teranishi | |
| 4,056,707 | A | 11/1977 | Farnam | |
| 4,067,480 | A | 1/1978 | Gasser | |
| 4,069,949 | A | 1/1978 | Ryckman, Jr. | |
| 4,094,446 | A | 6/1978 | Brutsman | |
| 4,140,247 | A | 2/1979 | Rice | |
| 4,349,131 | A | 9/1982 | Arabian | |
| 4,544,085 | A | 10/1985 | Frazer | |
| 4,595,131 | A | 6/1986 | Ruskin et al. | |
| 4,624,395 | A | 11/1986 | Baron et al. | |
| 4,968,166 | A | 11/1990 | Ingram | |
| 4,971,229 | A | 11/1990 | Heimlich | |
| 4,974,319 | A | 12/1990 | Maguire, Jr. et al. | |
| 5,289,951 | A | 3/1994 | Burrows | |
| 5,320,250 | A | 6/1994 | La et al. | |
| 5,513,771 | A | 5/1996 | Cote | |
| 5,524,792 | A | 6/1996 | Wakabayashi et al. | |
| 5,590,582 | A | 1/1997 | Weiss | |
| 5,700,991 | A | 12/1997 | Osbern | |
| 5,747,102 | A | 5/1998 | Smith et al. | |
| 5,780,819 | A | 7/1998 | Fabrikant et al. | |
| 5,786,573 | A | 7/1998 | Fabrikant et al. | |
| 5,803,317 | A | 9/1998 | Wheeler | |
| 5,811,766 | A | 9/1998 | Fabrikant et al. | |
| 5,832,178 | A | 11/1998 | Schave | |
| 5,913,455 | A | 6/1999 | La et al. | |
| 5,950,867 | A | 9/1999 | Martindale et al. | |
| 5,979,796 | A | 11/1999 | Ponziani et al. | |
| 6,003,733 | A | 12/1999 | Wheeler | |
| 6,016,935 | A | 1/2000 | Huegerich et al. | |
| 6,056,160 | A | 5/2000 | Carlucci et al. | |
| 6,098,524 | A | 8/2000 | Reese | |
| 6,179,162 | B1 | 1/2001 | Motsenbocker | |
| 6,204,485 | B1 | 3/2001 | Williams | |
| 6,253,957 | B1 | 7/2001 | Messerly et al. | |
| 6,311,868 | B1 | 11/2001 | Krietemeier et al. | |
| 6,361,752 | B1 | 3/2002 | Demarest et al. | |
| 6,415,957 | B1 | 7/2002 | Michaels et al. | |
| 6,655,552 | B2 * | 12/2003 | Aiken et al. | 222/146.3 |
| 6,795,645 | B2 * | 9/2004 | Hygema et al. | 392/477 |
| 6,978,912 | B2 * | 12/2005 | Taylor et al. | 222/146.3 |
| 2006/0113326 | A1 * | 6/2006 | Taylor et al. | 222/146.5 |

* cited by examiner

DISPENSING APPARATUS FOR RECEIVING A NUMBER OF DIFFERENTLY SIZED FOAM CANISTERS

CROSS-REFERENCE TO RELATED APPLICATIONS

This application claims priority to U.S. Provisional Patent Application Ser. No. 60/467,947 filed on May 5, 2003.

BACKGROUND OF THE INVENTION

1. Field of the Invention

The present invention relates to a dispensing apparatus for dispensing heated foaming liquid. More particularly, the present invention relates to an adjustable dispensing apparatus that selectively fits over and allows a number of differently sized canisters access to the dispensing apparatus to promote increased productivity.

2. Description of the Related Art

Commercial hot lather dispensers are known in the art. One such application of such commercial hot lather dispensers is used in barbershops. Another application is in residential, non-commercial consumer toiletries settings. The consumer heated foaming liquid dispensers are used with a wide variety of foam canisters. Different commercial brands of foam canisters often have different sizes.

The foam canisters often are cylindrical shaped and have a height and a first diameter. On a top portion of the foam canister is a short shelf that also has a second diameter. Often this second diameter is different than the first diameter. The short shelf often has a valve stem thereon. The valve stem is often under a removable spray cap. The valve stem has a height, and the spray cap is disengageable from the valve stem.

A high demand exists in the non-commercial or residential settings for a heated foaming liquid shave. A consumer may enjoy a relaxing heated foaming liquid shave by using a dispensing apparatus that is analogous to a barbershop dispensing apparatus without the increased service cost, the waiting time for the barber, and the travel time associated from the consumer's home to the barbershop.

In the commercial setting however, the commercial heated foaming liquid dispensing apparatuses are relatively uniform from barbershop to barbershop. A barber may purchase from a vendor a relatively large canister of the heated foaming liquid that will easily fit into the commercial heated foaming liquid dispensing apparatus. However, the situation is quite different for home use. Often, the consumer will purchase foaming liquid that can be used either with a hot shave dispenser or shaving at ambient conditions. Each canister will be differently sized and shaped. Each foam canister has different heights, different shelf sizes, and different first and second diameters. Various problems result with the foam canister fitting into the residential dispenser. Often consumers are reluctant to purchase numerous dispensers with different sizes and configurations to accommodate the differently sized foam canister. Moreover, if the consumer has a first sized dispenser, the consumer may be precluded from purchasing a second sized foam canister because the second sized foam canister may not fit. This situation is detrimental because the user may be precluded from a desirable brand of shaving cream, for example for sensitive skin or having a preselected additive or attribute such as a softener.

One attempt in the art to remedy this problem in the art is U.S. Pat. No. 3,990,612 to Gasser. Gasser discloses a pressurized can of shaving cream connected to a dispenser. The pressurized can has a valve stem that is connected to aluminum tubing with an outlet valve. The aluminum tubing is soldered or brazed to the valve stem. Hot water from the consumer's bathroom shaving sink is poured over the aluminum tubing to heat the shaving cream that is released therein. Upon shaving, the user manipulates the outlet valve to release the heated foaming liquid.

However, this dispenser is not satisfactory since it is difficult for the aluminum tubing to remain balanced and fixed on a number of differently sized containers. Also, if the user lets go of the aluminum tubing, the valve stem may break off of the can. With the valve stem broken, the foam canister or can is unusable. Furthermore, the soldering operation to connect the valve stem of the canister to the dispenser is time consuming. Further, the consumer may not wish to purchase such a dispenser because of the time associated with usage of the dispenser. Furthermore, the dispenser may fall over and become separated from the canister during shaving.

Accordingly, there is a need for a reliable dispenser for use with a number of sizes of canisters. There is also a need for such a reliable and safe, dispenser that will engage the canister and also disengage from the canister in a quick manner without undue effort by the consumer.

There is also a need for such a dispenser that eliminates one or more of the aforementioned drawbacks and deficiencies of the prior art.

SUMMARY OF THE INVENTION

It is an object of the present invention to provide a dispensing apparatus for a foam canister where the dispensing apparatus can be easily removed or pulled from the canister without damaging the foam canister.

It is another object of the present invention to provide a dispensing apparatus that is safe and that will heat foam in the foam canister and eject the heated foam to a consumer.

It is yet another object of the present invention to provide a dispensing apparatus that can sturdily fit over a number of differently sized foam canisters.

It is still another object of the present invention to provide a dispensing apparatus that has a member on a bottom portion selectively covering an opening on the bottom portion of the dispensing apparatus to selectively change a size of the opening to sturdily fit over a number of differently sized foam canisters.

It is still yet another object of the present invention to provide a dispensing apparatus that has a height that is adjustable and has an opening on a bottom portion of the dispensing apparatus with the opening being adjustable to fit over a number of differently sized foam canisters.

It is a further object of the present invention to provide a base collar that connects to a dispensing apparatus and has a number of threads for adjusting the height of the base collar relative to the dispensing apparatus and, thus, fit over a number of differently sized foam canisters.

These and other objects and advantages of the present invention are achieved by a dispenser of the present invention. The dispenser is for heating and dispensing foam from a canister. The dispenser has a heater for providing heat to the foaming liquid and a chamber with an inlet port and an outlet port. The chamber is preferably in contact with the heater, and the outlet port is connected to a nozzle. The nozzle dispenses the heated foaming liquid. The dispenser also has a base adjoining the inlet port with the base having an aperture and a first member. The first member is slidably retained over the aperture, and adjusts a size of the aperture to selectively receive the canister. The first member is adjustable to receive a number of canisters each of the canisters having a number of different sizes.

DETAILED DESCRIPTION OF THE INVENTION

Figure 1:
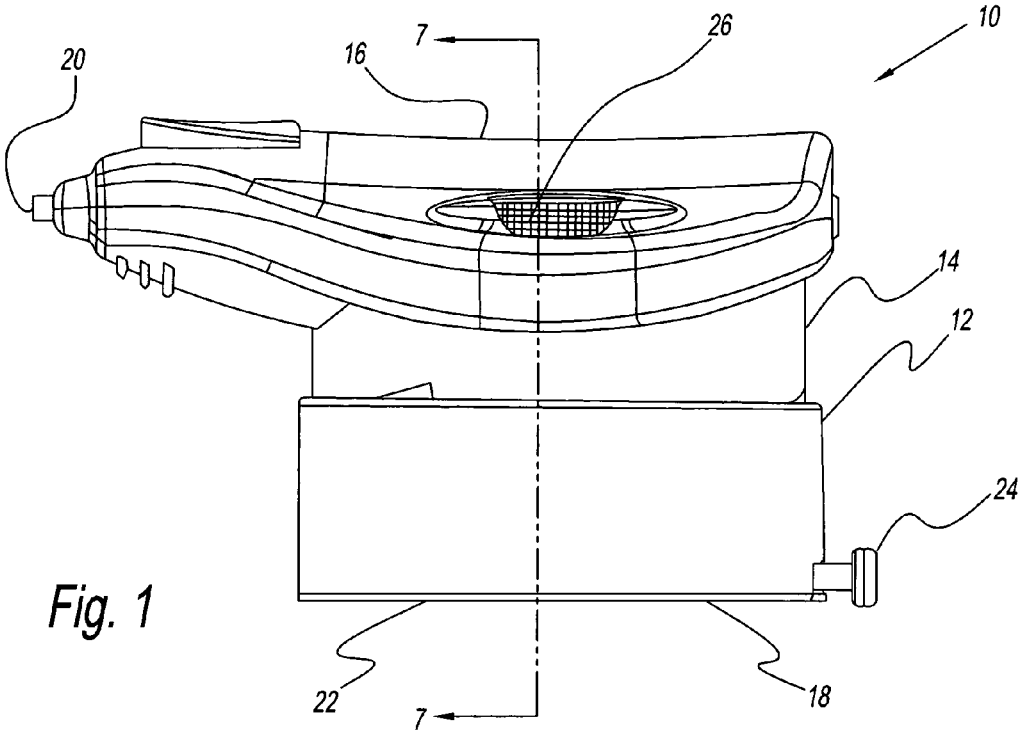
FIG. 1 is a side view of a preferred embodiment of a dispensing apparatus adapted to be fitted over a number of differently sized canisters according to the present invention.
Figure 2:
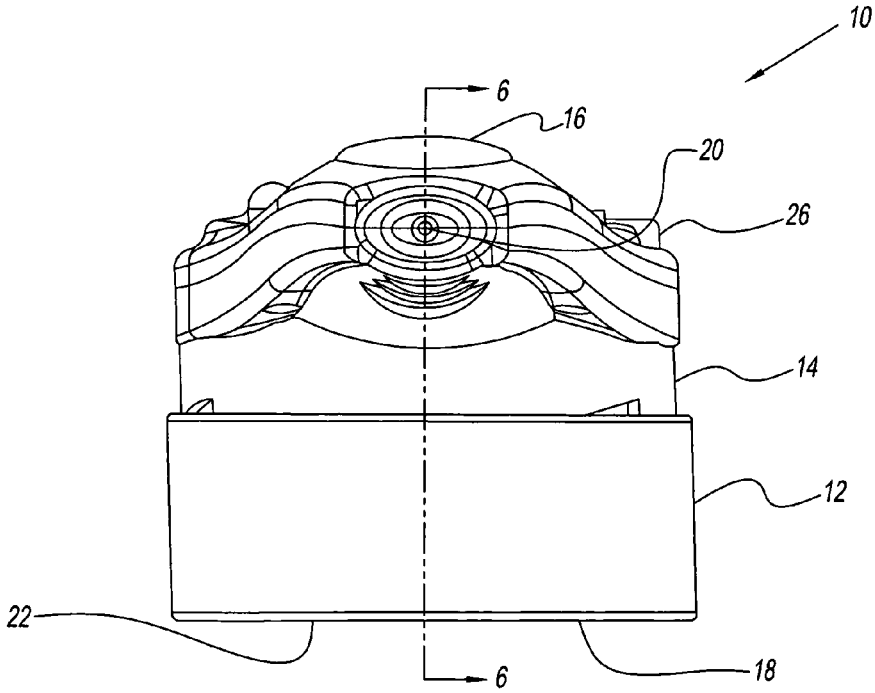
FIG. 2 is a front view of the dispensing apparatus of FIG. 1.
Figure 3:
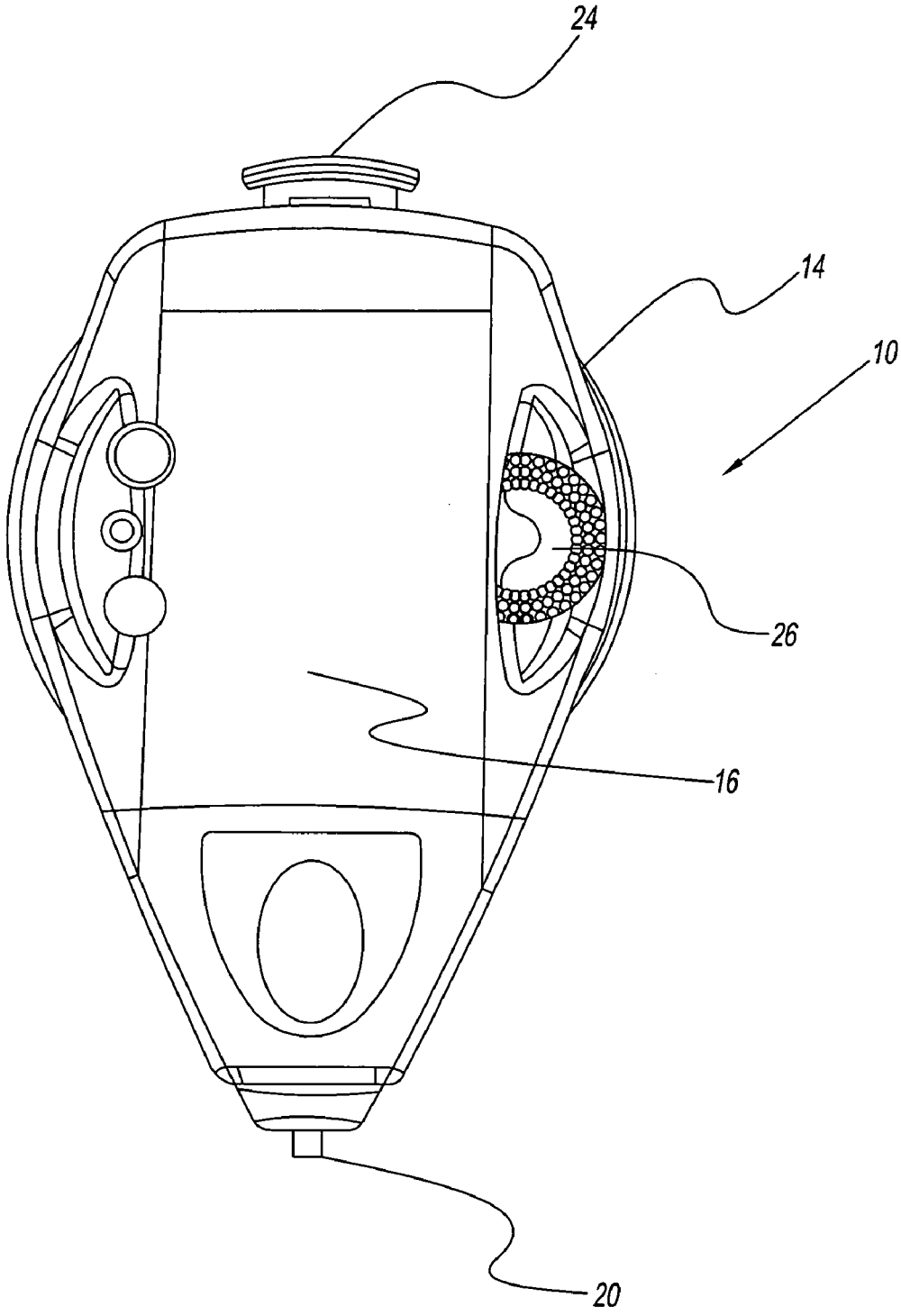
FIG. 3 is a top view of the dispensing apparatus of FIG. 1.

Referring to the figures and in particular FIG. 1 through 3, there is shown a dispensing apparatus of the present invention generally represented by reference numeral 10. The dispensing apparatus 10 is preferably connectable to a base collar 12. The dispensing apparatus 10 preferably dispenses a heated foam from a canister to a user. The dispensing apparatus 10 is clearly suitable for use in a home.

The base collar 12 preferably is a resilient ring for surrounding a portion of the dispensing apparatus 10 and for allowing the foam canister access to the dispensing apparatus. Alternatively, the dispensing apparatus 10 and the base collar 12 may be either removably or permanently connected to one another. Still further, the dispensing apparatus 10 and the base collar 12 may be manufactured as one integral member by molding. One exemplary aspect of the present invention is that the base collar 12 connected to the dispensing apparatus 10 can receive all or virtually all commercially sold canisters for emitting foam even those having a number of different sizes and geometries.

Referring to FIG. 1, the dispensing apparatus 10 has a housing 14. Preferably, the housing 14 is made from a durable and resilient material. The housing 14 houses and protects one or more interior components of the dispensing apparatus 10. Moreover, the housing 14 preferably is a heat resistant material. Accordingly, upon heating the foaming liquid in the dispensing apparatus the housing will nonetheless remain durable and resilient for many uses. Preferably, the housing 14 is a thermoplastic, a metal material, a composite material, or any combinations thereof.

The housing 14 has a top side 16, and a bottom side 18 preferably opposite the top side 16. Referring to FIGS. 2 and 3, preferably the housing 14 has a nozzle 20 with an opening for regulating and directing a fluid flow of the heated foam exiting the dispensing apparatus 10. Preferably, the top side 16 of the housing 14 is generally flat and horizontal, without a slant or curvature, to allow a consumer to push the top side an amount to release heated foam from a nozzle 20. The nozzle 20 extends from an elongated portion of the housing 14. However, various design modification are possible and the nozzle 20 may be placed in any suitable location in or on the housing 14.

Referring to FIGS. 1 and 2, the dispensing apparatus 10 further has the base collar 12 with an opening 22. Preferably, the opening 22 is adjacent to the bottom side 18 of the dispensing apparatus 10. Preferably, the canister (not shown) filled with liquid that emits as foam will be inserted in the opening 22. Upon actuation of the dispensing apparatus 10, the heated foam will be released out of the nozzle 20.

Referring to FIG. 3, the dispensing apparatus 10 has a knob 24. The knob 24 preferably is adjacent to the opening 22 on the bottom side 18 of the housing 14. Preferably, the knob 24 is connected to the base collar 12 in a suitable notch. Preferably, this knob 24 selectively adjusts a size of the opening 22 of the base collar 12 to permit a range of canisters to fit in the opening 22.

The dispensing apparatus 10 preferably has a control dial 26. The control dial 26 is disposed in the top side 16 of the housing 14. Preferably, the control dial 26 is an analog dial, however one skilled in the art should appreciate that the control dial may be any movable control knob, a digital device, or other device known in the art, to change one or more operating functions of the dispensing apparatus 10. For example, the control dial 26 may be adjustable from a minimum position to a maximum position to control: the heating of the foam exiting the nozzle 20, a mass flow rate of the foam exiting the nozzle, a size of the opening 22, or any other operating function of the dispensing apparatus 10.

Figure 4:
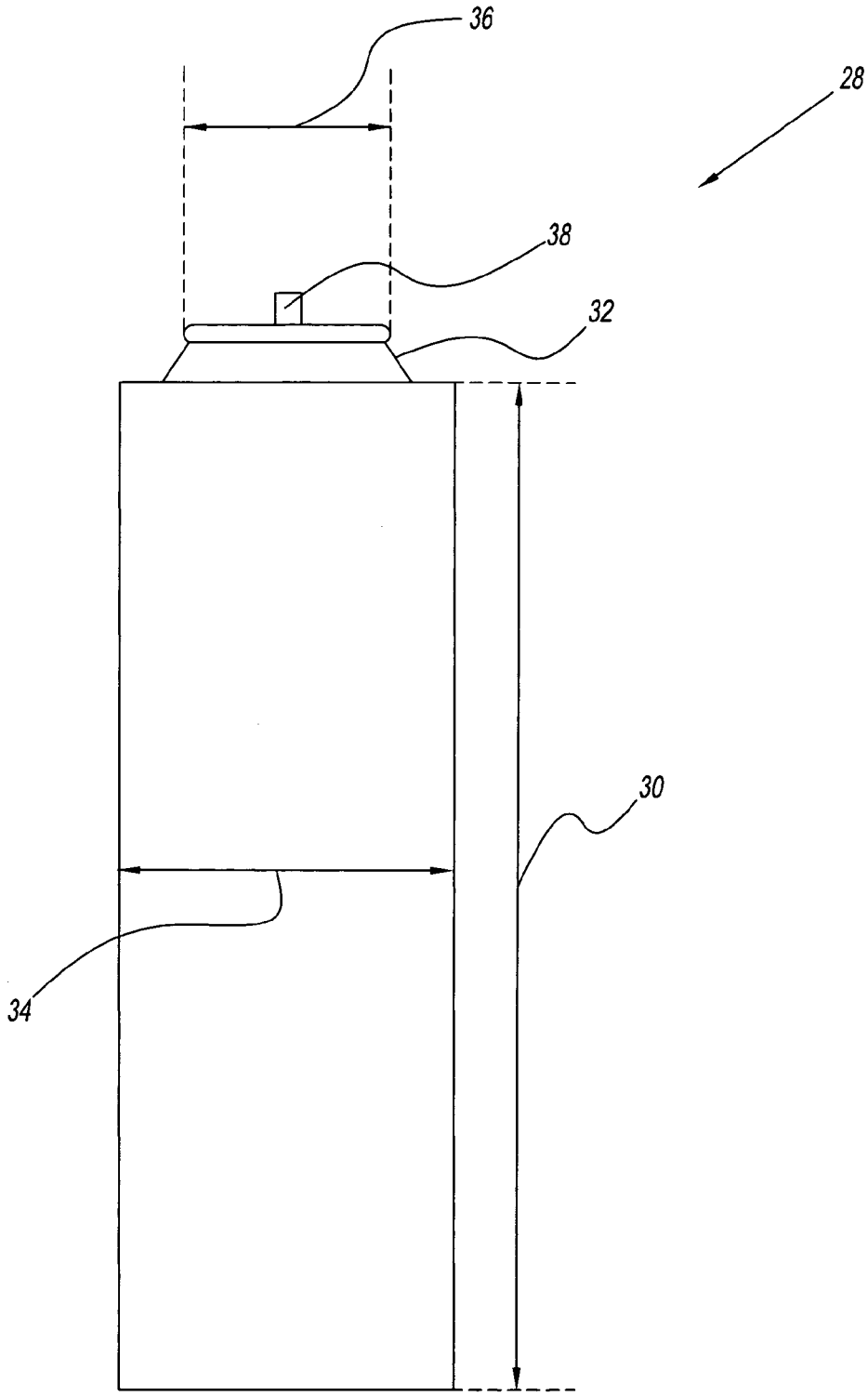
Fig. 4 (Prior Art)
FIG. 4 is a front view of a canister of the prior art with a cap being removed.

Referring to FIG. 4, prior art consumer dispensing devices have operational problems. Often, consumers will purchase foam, shave creams or lathers in canisters 28, such as one as shown in FIG. 4. These canisters 28 or cans often are from different commercial producers, and moreover have different sizes. Often the canisters are constructed with a height 30, a shelf 32, a first diameter 34, a second diameter 36, and a valve stem 38. One skilled in the art should appreciate that a removable spray cap (not shown) is typically sold with the canister 28. In FIG. 4, the canister 28 is shown with the cap removed from the canister. The canister 28 may have the first diameter 34 and the second diameter 36 too large to fit into any opening in the prior art dispensers, or have the first diameter and the second diameter too small to be retained in any opening in the prior art dispensers. Additionally, the canister 28 may have the height 30. This height 30 may be differently sized from canister 28 to canister. The height 30 could cause problems with the canister 28 retained in any opening in the prior art dispensers.

Figure 5:
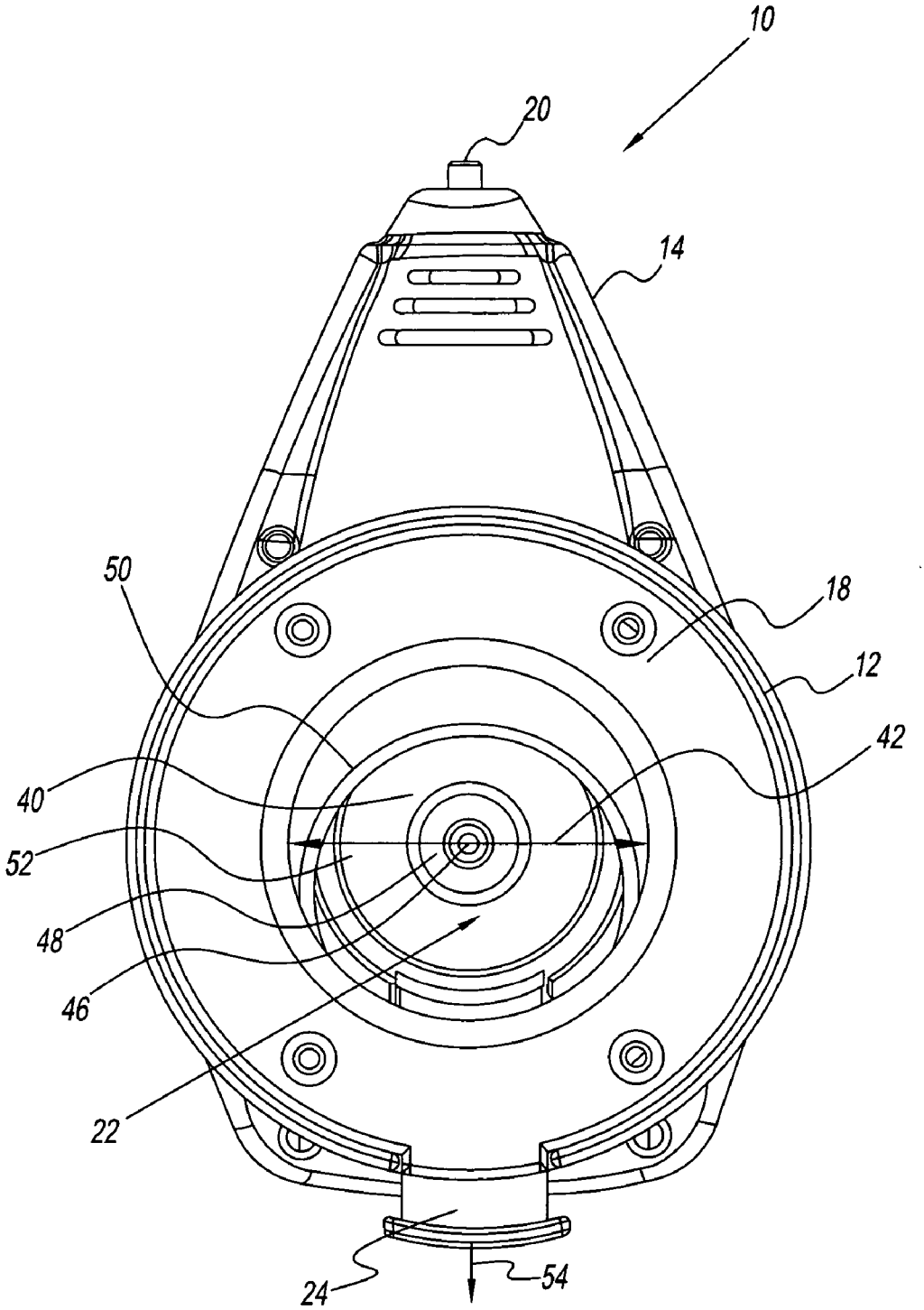
FIG. 5 is a bottom view of the dispensing apparatus of FIG. 1.

The dispensing apparatus 10 with the base collar 12 of the present invention remedies this problem in the art. Referring to FIG. 5, the dispensing apparatus 10 has a bottom side 18 and the base collar 12. The base collar 12 preferably has a first aperture 40. The first aperture 40 preferably has the same general configuration as the opening 22 of the dispensing apparatus 10. The first aperture 40 further is disposed in the bottom side 18 of the dispensing apparatus 10. Preferably, the first aperture 40 is generally circular in shape, however one skilled in the art should appreciate that the first aperture 40 may have any shape known in the art including an elliptical shape, an orthogonal shape, a rectangular shape, or an irregular shape. The first aperture has a first diameter 42 that is of a suitable size to allow the canisters 28 with the shelf 32 having a largest sized second diameter 36, as shown in FIG. 4, to fit therein.

The dispensing apparatus 10 preferably also has an inlet port 46. The inlet port 46 is illustrated as being through the first aperture 40 of the base collar 12 and the opening 22 of the dispensing apparatus 10. The inlet port 46 is preferably an opening that has a complementary size relative to the valve stem 38 of the canister 28 as shown in FIG. 3. The inlet port 46 preferably allows access to an interior of the dispensing apparatus 10 for heating the liquid and, thus, the foam that enters the dispensing apparatus. Preferably, the inlet port 46 is on a generally flat surface 48 located opposite the opening 22. Preferably, the inlet port 46 is located in a centermost portion of the flat surface 48 in mirror image to a location of the valve stem 38 on the shelf 32 of the canister 28, as shown in FIG. 4.

The base collar 12 preferably has a device for selectively changing the size of the opening 22. In one embodiment, the device is a first member 50. Preferably, the first member 50 is a disc shaped resilient member. The first member 50 has a second aperture 52 thereon. The second aperture 52 in one position aligns with the first aperture 40. Thereafter, upon being manipulated into a second position, the second aperture 52 misaligns and thus blocks a predetermined portion of the first aperture 40 to reduce the size of the first aperture.

Less preferably, the first member 50 has a flat, thin circular shape. Alternatively, the first member 50 may be split into a number of members to block a predetermined portion of the first aperture 40 and to selectively reduce the size of the first aperture.

Preferably, the first member 50 is formed in the base collar 12 and is a resilient and lightweight member and, thus, can traverse laterally in a quick and rapid fashion. Preferably, the first member 50 is made from a thermoplastic, a metal or any other resilient and lightweight material known in the art. As mentioned above, the first member 50 has the second aperture 52 disposed through the first member. The second aperture 52 has a diameter that is about the same diameter as the first diameter 42 of the first aperture 40. The second aperture 52 preferably allows a portion of the canister 28 to selectively access the interior of the base collar 12. Preferably, a biasing device (not shown) biases the first member 50 so the first member will favor one lateral side of the first aperture 40 over another lateral side of the first aperture. Thus, upon being moved laterally, the biasing device will return the first member 50 and the second aperture 52 to an initial position. The biasing device may be any spring, coil or any other biasing device known in the art. The biasing device preferably is connected to the bottom side 18 of the base collar 12 in an aesthetically pleasing manner.

The first member 50 is connected to the knob 24 in preferably adjacent to the second aperture 52. Preferably, the knob 24 is connected at a first radial location on the first member 50 at a lateral side thereof. However, one skilled in the art should appreciate that the knob 24 may be connected to the first member at any location on the first member. Preferably, the knob 24 and the first member 50 are connected to one another by a molding operation. However, one skilled in the art should appreciate that the first member 50 and the knob 24 may be connected by an adhesive, a mechanical fastener or any other manner know in the art, or even be manufactured as one member.

The first member 50 preferably moves laterally across the bottom side 18 of the base collar 12 of the dispensing apparatus 10 from a first location to a second location, as well as, intermediate locations between the first location and the second location. The embodiment shown in FIG. 5 shows the first member 50 in the intermediate location.

Preferably, the first aperture 40 of the base collar 12 aligns with the second aperture 52 of the first member 50 in the first location. However, upon the first member 50 traversing laterally across the bottom side 18 of the base collar, the first aperture 40 of the base collar 12 will be partially misaligned with the second aperture 52 of the first member 50. Thus, the first member 50 selectively blocks and makes the first aperture 40 of the base collar 12 relatively smaller than the first diameter 42 of the first aperture. Preferably, the first member 50 is connected to the knob 24, as shown, and moves in response to manipulation of the knob in a direction of reference arrow 54.

Figure 6:
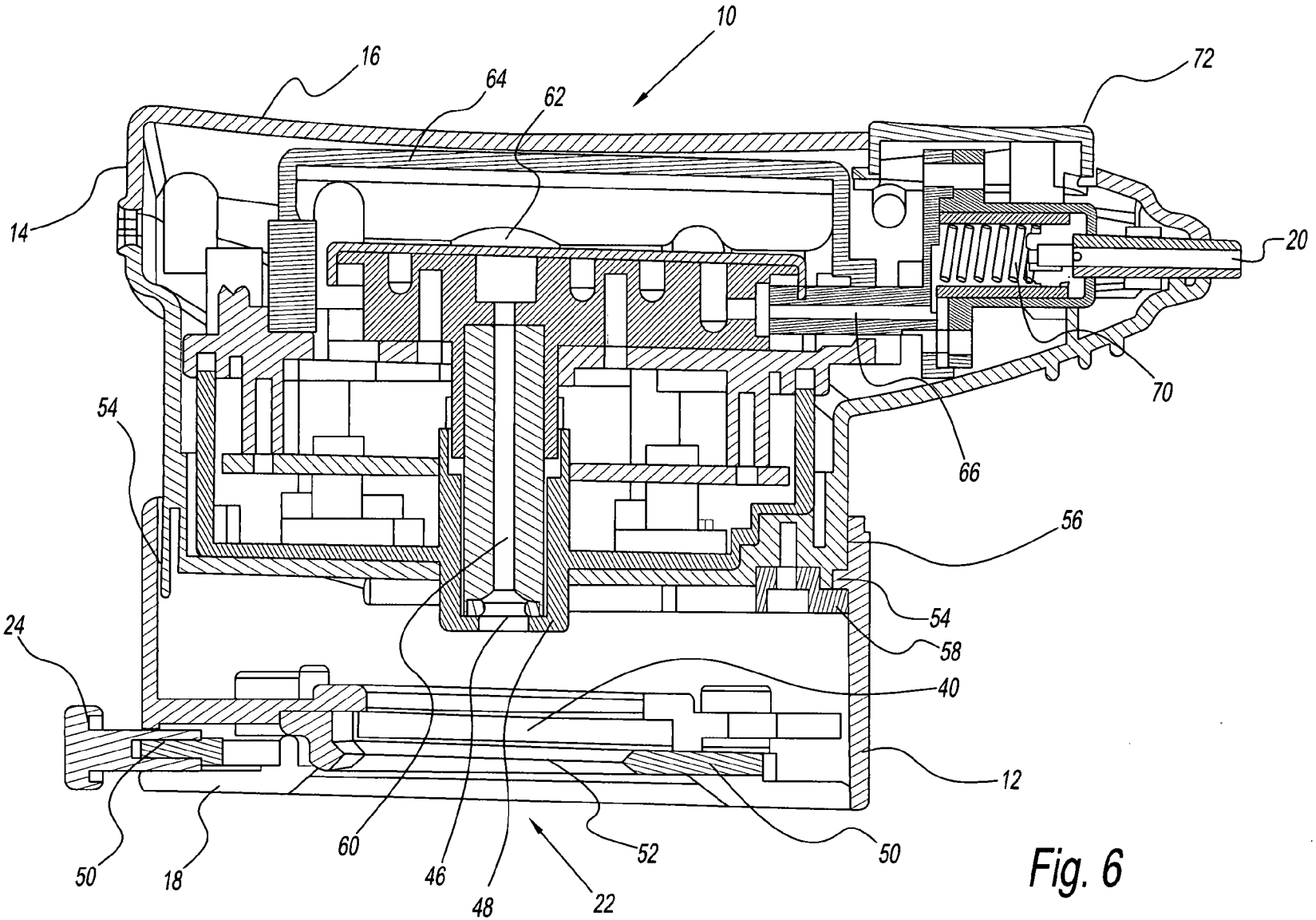
FIG. 6 is a cross sectional view of the dispensing apparatus of FIG. 2 along line 6—6 of FIG. 2.

The knob 24 is connected to the first member 50 as shown in FIG. 6. In this embodiment, the knob 24 has a notch therein for connecting over a lateral side of the first member 50. In this manner, the first member 50 will traverse in the same direction as the knob 24 is manipulated.

The first member 50 adjusts a size of the opening 22 to permit a variety of sized canisters 28 access therein. In the first location, the user can place and retain the shelf 32 through the opening 22. Once placed in the base collar 12, the valve stem 38 of the canister 28 can be engaged into the inlet port 46 of the dispensing apparatus 10. Upon the valve stem 38 being in the engaged position, the first member 50 will traverse from the first location toward the second location to a preferred and predetermined intermediate location. In this intermediate location, the first member 50 will contact and selectively retain the shelf 32 of the canister 28 in position around the base collar 12 of the dispensing apparatus 10. Thus, the canister 28 is retained on the dispensing apparatus 10 for a relaxing heated foam shave.

Another problem in the art is that a height of the shelf 32 of the canister 28 will not fit in the base collar 12. The dispensing apparatus 10 and the base collar 12 of the present invention remedy this known problem in the art. Preferably, the base collar 12 is adjustable relative to the dispensing apparatus 10 by a number of threads 54. The number of threads 54 are disposed on an inner surface 56 of the base collar 12. Preferably, the number of threads 54 engage and mate with an adjustable threaded engagement 58. In this manner, a vertical position of the base collar 12 relative to the dispensing apparatus 10 can moved and/or adjusted in a vertical manner to compensate for a number of differently sized shelves 32 of the canister 28 and preferably simply by a selective rotation of the adjustable threaded engagement 58.

Preferably, the inlet port 46 is connected to a tubular member 60. The tubular member 60 extends substantially perpendicular relative to the top side 16 of the dispensing apparatus 10. The tubular member 60 then fluidly connects to a chamber 62. The chamber 62 is preferably an enclosed space or compartment in the dispensing apparatus 10. The chamber 62 is also connected to an intermediate tubular member 66. The intermediate tubular member 66 is further connected to an outlet port 68. Preferably, the outlet port 68 is an opening allowing the heated foam/liquid to emit from the dispensing apparatus 10. The nozzle 20 is connected to the outlet port 68. The nozzle 20 on the outlet port 68 facilitates the heated foam from escaping the dispensing apparatus 10.

Preferably, the dispensing apparatus 10 has a heater 64. Preferably, the heater 64 provides heat to the chamber 62 and related areas of the dispensing apparatus 10 and is connected to a power supply (not shown) in a conventional manner, such as by leads. In one exemplary embodiment of the present invention, the heater 64 is disposed proximal to the chamber 62. Also, the heater 64 is a heater wire. In another embodiment of the present invention, the heater 64 is a positive temperature coefficient heater.

In operation, the foam/liquid in the canister 28 is stored under pressure. When the valve stem 28 is connected to the inlet port 46, the foam is released from the valve stem into the inlet port. The foam/liquid then traverses from the tubular member 60 to the chamber 62. Once in the chamber 62, the heater 64 heats the foam/liquid. The heater 64 may be selectively adjusted by the control dial 26 to control a temperature of the heated foam/liquid. The heated foam/liquid then traverses from the chamber 62 to the intermediate tubular member 66. In the intermediate tubular member 66, the heated foam/liquid traverses the outlet port 68 and through the nozzle 20 to the user for shaving.

Preferably, the outlet port 68 has a valve spring 70 that is connected to a lever 72. When the user desires an amount of heated foam/liquid, the user will toggle the lever 72. The lever 72, in response, actuates the valve spring 70 causing a valve to move in a direction toward the intermediate tubular member 66 to release the valve and allow the heated foam/liquid to traverse through the nozzle 20.

Figure 7:
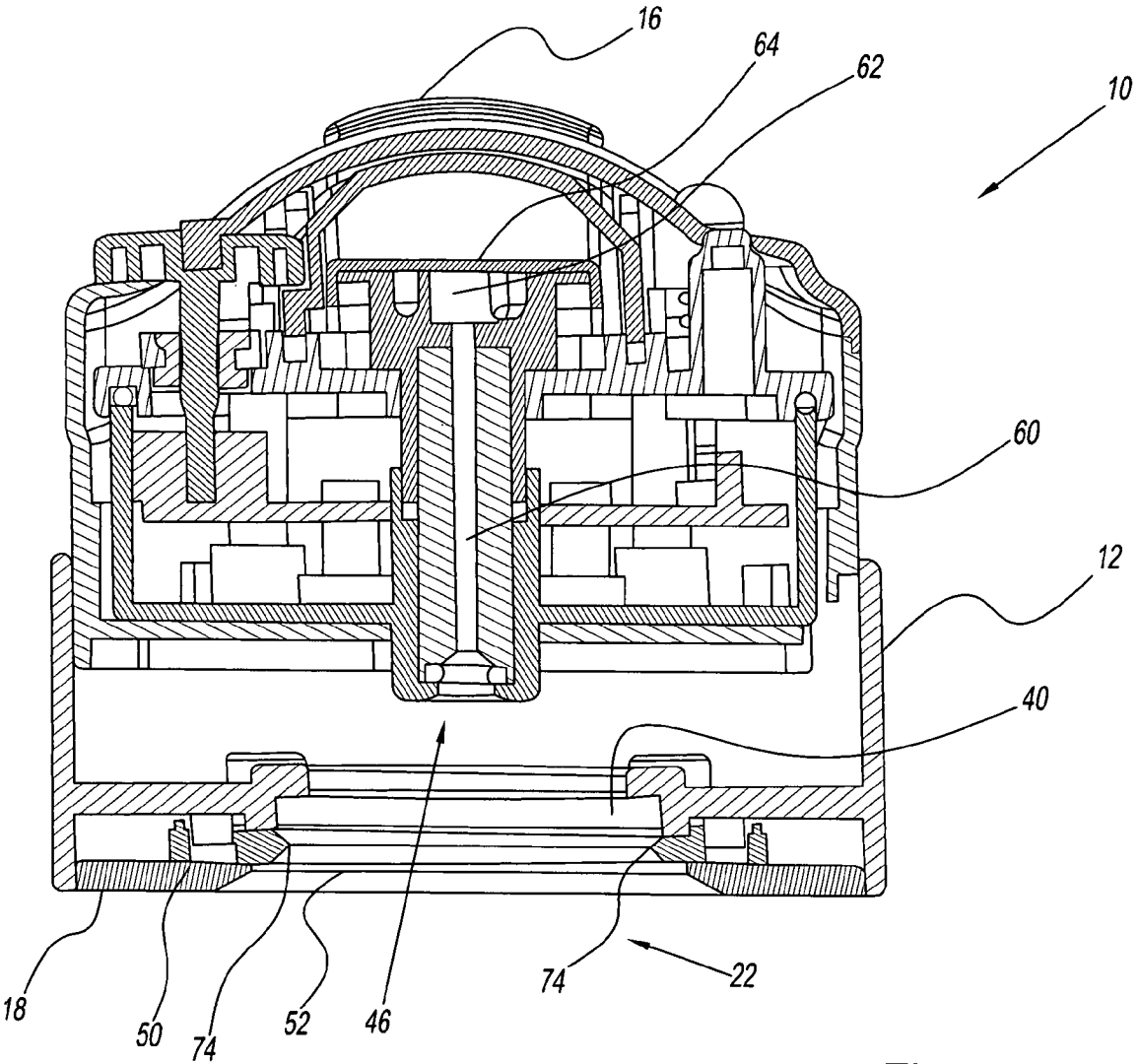
FIG. 7 is another cross sectional view of the dispensing apparatus along line 7—7 of FIG. 1.

Referring to FIG. 7, there is shown another cross sectional view of the dispensing apparatus 10 connected to the base collar 12 along line 7—7 of FIG. 1. As is shown, the second aperture 52 of the first member 50 is aligned with the first aperture 40 of the base collar 12 to allow the first aperture to coincide with the second aperture. The first member 50 has an edge-gripping portion 74. One skilled in the art should appreciate that although shown as triangular in shape, the first member 50 may be toothed, made from a high friction material, or have any other feature to more easily retain the shelf 32 of the canister 28 in the second aperture 52.

Figure 8:
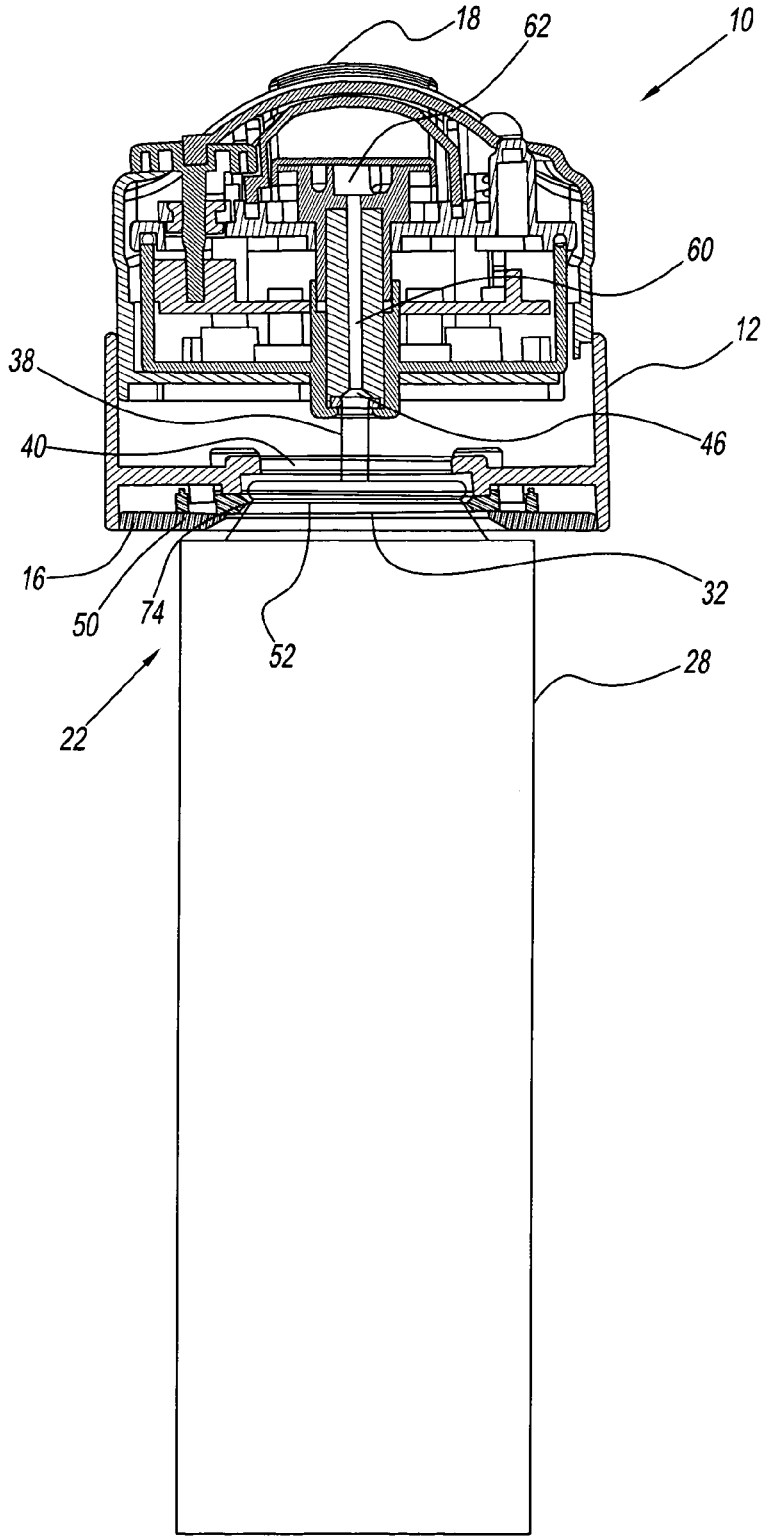
FIG. 8 is the cross sectional view of the dispensing apparatus of FIG. 7 removably connected to the foam canister of FIG. 4.

Referring to FIG. 8, there is shown the canister 28 disposed in the base collar 12 of the dispensing apparatus 10. The first member 50 with the edge-gripping portion 74 is shown a triangular shaped feature extending form the first member 50 around the second aperture 52. Preferably, the edge-gripping portion 74 facilitates the first member 50 gripping and retaining the shelf 32 of the canister 28 in the opening 22. One skilled in the art should appreciate that the first member 50 is connected to the biasing device to hold the canister 28 in the opening 22 of the dispensing apparatus 10. The user may manipulate the knob 24 to free and remove the canister 28 from the dispensing apparatus 10, and replace the canister with a new canister including one having a different geometry or a different brand of foam/liquid.

Figure 9:
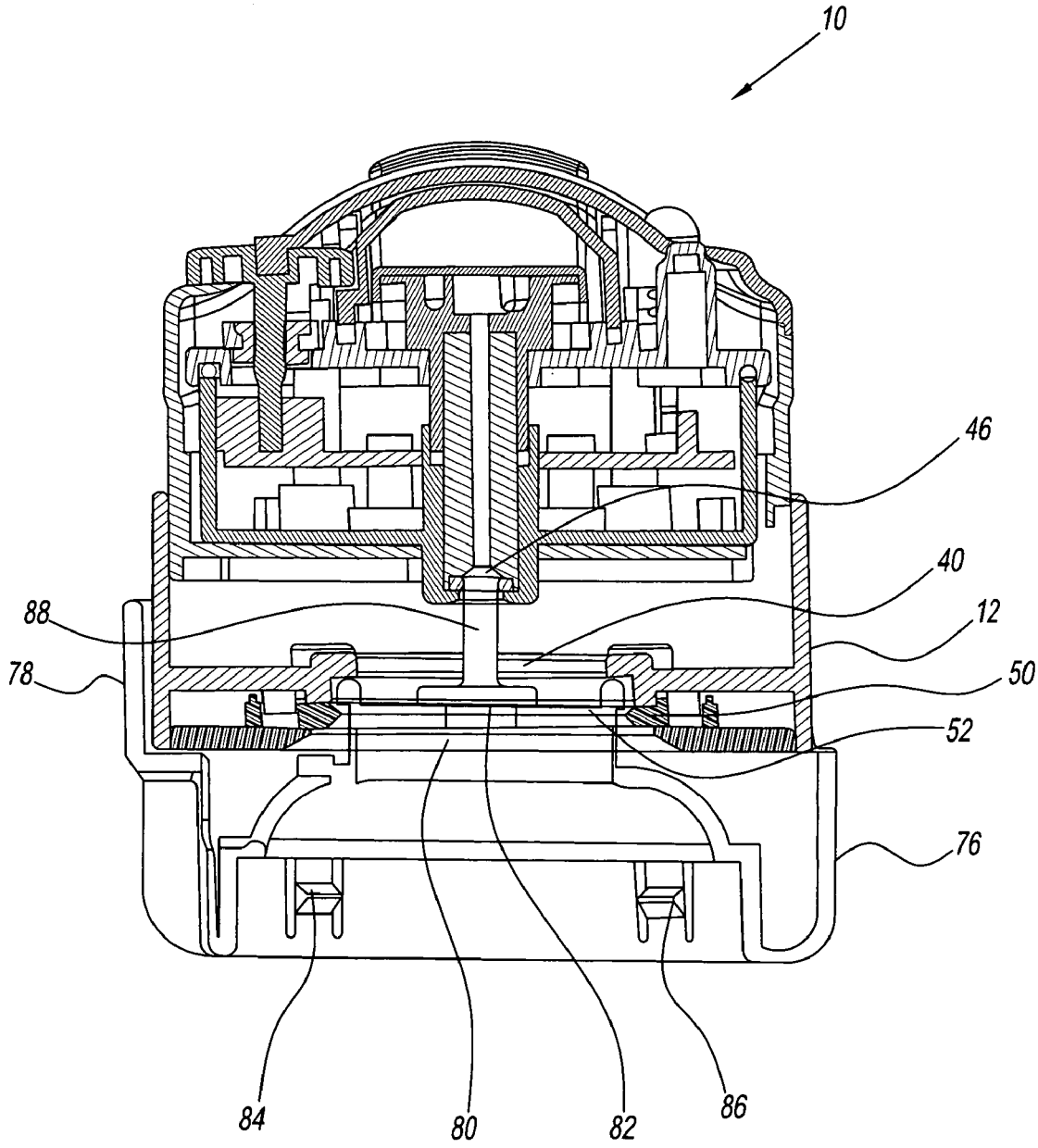
FIG. 9 is cross sectional view of another the preferred embodiment of the dispensing apparatus of FIG. 3 along line 7—7 of FIG. 3.

Referring to FIG. 9, the dispensing apparatus 10 of this embodiment has a detachable base cap 76. The detachable base cap 76 preferably can be secured on or to the bottom side 18 of the dispensing apparatus 10 to prevent excess foam/liquid from escaping out of the bottom side. The detachable base cap 76 is removably disposed on a bottom most portion of the base collar 12. The detachable base cap 76 preferably has a gripping member 78 to snap fasten to the base collar 12. In this manner, the detachable base cap 76 may be selectively connected to the bottom side 18 of the base collar 12. The detachable base has a basin 80. The basin 80 is preferably opposite the dispensing apparatus 10 and has an opening 82 shown in FIG. 10 to introduce the valve stem 38 of the canister 28 therein. The basin 80 further has a first tab 84 and a second tab 86 to secure the canister 28 thereon.

Figure 10:
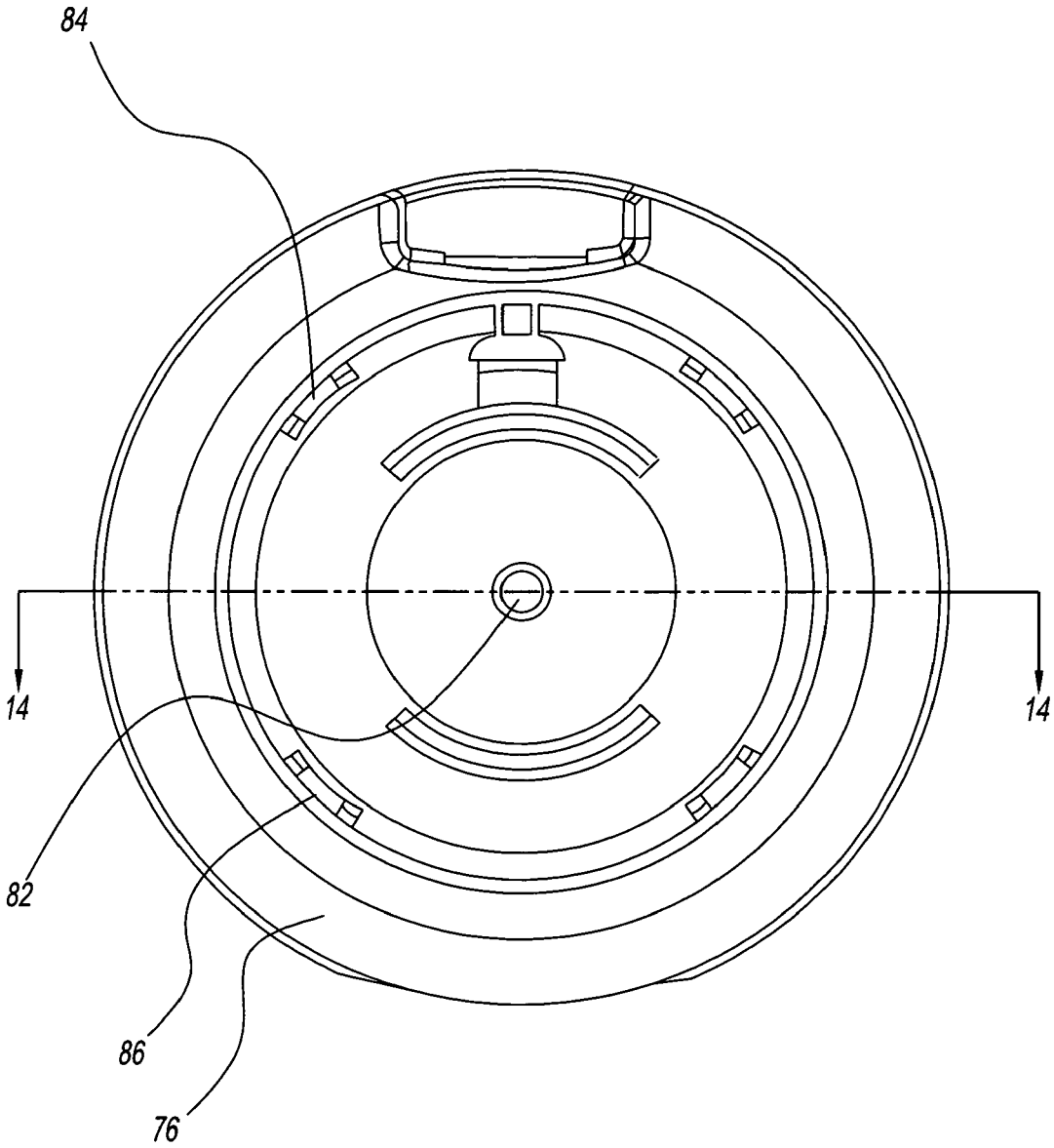
FIG. 10 is a top view of the detachable base cap used with the dispensing apparatus of FIG. 1.

Referring again to FIG. 9, the detachable base cap 76 preferably has a protruding center tubular member 88 connected to the detachable base cap. The protruding center tubular member 88 is preferably a member that prevents any excess foam/liquid released from the valve stem 38 or aggregating on the valve stem, to escape and stain a user's clothes during nonuse. Referring to FIG. 10, the valve stem 38 of the canister 28 preferably is positioned through the opening 82 and into the protruding center tubular member shown in FIG. 12 when introduced into the base collar 12. In this manner, any excess foam that is released from the valve stem 38 will collect and be stored in the protruding center tubular member 88 and be prevented from exiting into the dispensing apparatus 10 or out of the opening 82, thereby avoiding a potentially messy condition.

Figure 11:
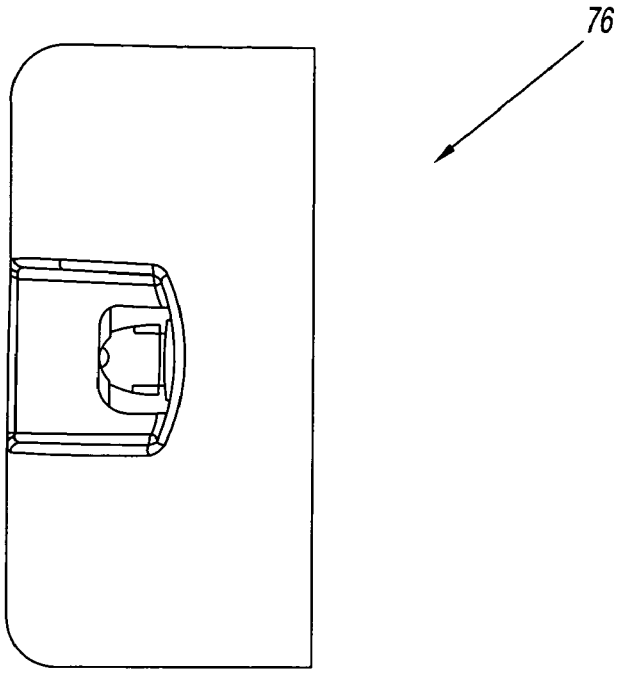
FIG. 11 is a front view of the detachable base cap of FIG. 10.
Figure 12:
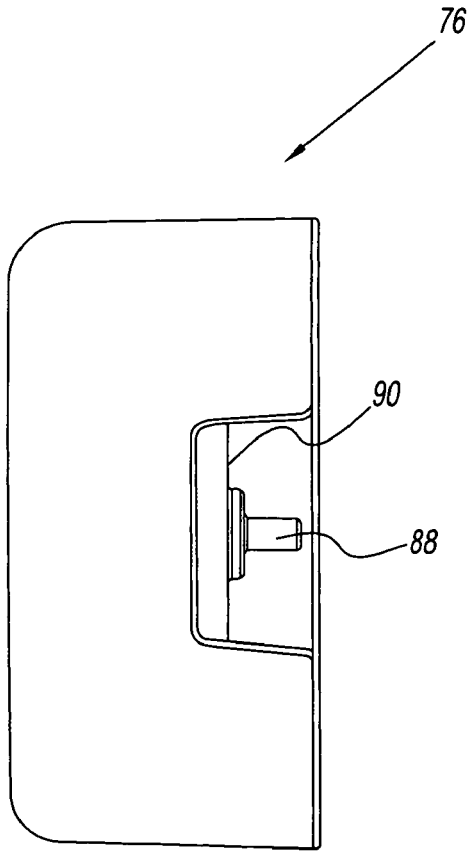
FIG. 12 is a rear view of the detachable base cap of FIG. 10.

FIG. 11 shows a side view of an exterior of the detachable base cap 76. One skilled in the art should appreciate that the detachable base cap 76 is made from a resilient lightweight material to facilitate transport. FIG. 12 shows another side view of the exterior of the detachable base cap 76, but this view is opposite the view of FIG. 11. The detachable base cap 76 has the protruding center tubular member 88 extending substantially perpendicular from the detachable base cap. Preferably, the protruding center tubular member 88 extends perpendicularly from a flat intermediate surface 90 disposed on the detachable base.

Figure 13:
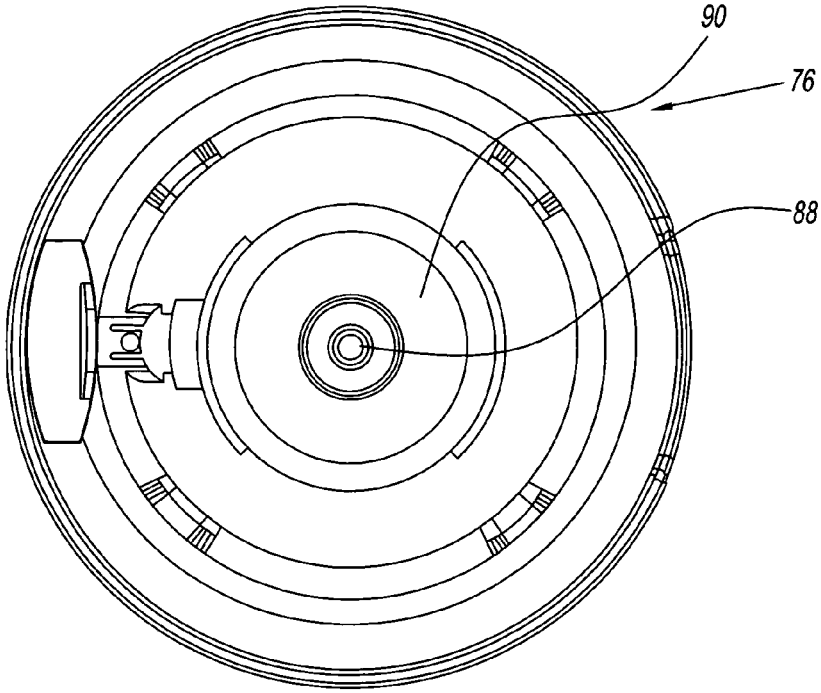
FIG. 13 is a bottom view of the detachable base cap of FIG. 10.
Figure 14:
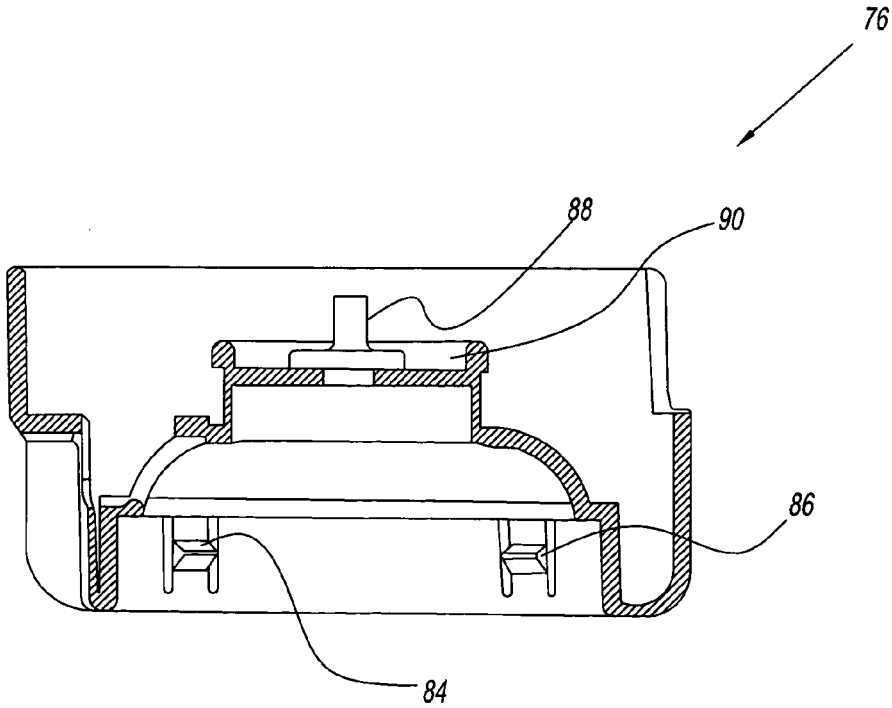
FIG. 14 is a cross sectional view of the detachable base cap along line 14—14 of FIG. 10 showing the protruding center tubular member of FIG. 9.

Referring to FIGS. 13 and 14, the interface between the protruding center tubular member 88 and the flat intermediate surface 90 are preferably sealed to prevent any excess of foam from the canister 28 to escape. The detachable base cap 76 and the protruding center tubular member 88 are both made from a resilient non-porous material, such as a metal, wood, a thermoplastic, a thermoset, or any other such resilient material.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A dispenser for heating and dispensing a liquid in anyone of a plurality of canisters, the dispenser comprising:

a heater for providing heat to the liquid;

a chamber having an inlet port and an outlet port, said chamber being in contact with said heater, said outlet port being connected to a nozzle, said nozzle for dispensing said heated liquid as foam; and a base adjoining said inlet port, said base having an aperture and a first member, said first member being slidably retained over said aperture, said first member for adjusting a size of said aperture to selectively receive anyone of the plurality of canisters.

2. The dispenser of claim 1, wherein each of the anyone of the plurality of canisters has a plurality of different sizes.

3. The dispenser of claim 1, wherein said first member can traverse said base from a first position for partially exposing said aperture to a second position for partially covering said aperture.

4. The dispenser of claim 3, wherein said first member has an actuator connected to said first member, and wherein said actuator adjusts said first member from the first position to the second position.

5. The dispenser of claim 4, wherein said actuator is a knob.

6. The dispenser of claim 1, wherein said first member is generally disc shaped.

7. The dispenser of claim 1, wherein said base is generally cylindrical in shape and has a top portion and a bottom portion, said top portion having a plurality of threads for adjusting a vertical position of said base relative to the dispenser.

8. The dispenser of claim 1, wherein said heater is a heater wire wound around said chamber.

9. The dispenser of claim 1, further comprising a cap having a tubular member connected to said inlet port for preventing the foam from escaping said aperture.

10. The dispenser of claim 1, wherein said base is a cylindrical shaped collar.

11. The dispenser of claim 10, wherein said cylindrical shaped collar is vertically adjustable relative to said chamber for adjusting a vertical height between said cylindrical shaped collar and said inlet port.

12. A dispenser for heating a liquid and dispensing a foam from a canister having a valve stem, the dispenser comprising:

a housing having a chamber, said chamber having an inlet port and an outlet port, said outlet port being connected to a nozzle, said nozzle being on an outer surface of the dispenser, said nozzle for selectively releasing the foam;

a heater for providing heat to the liquid, said chamber being in thermal contact with said heater; and a base collar being connected to said housing, said base collar being generally cylindrical in shape, said base collar having a first opening with a first diameter and a member, said member having a second opening with a second diameter, wherein said member is laterally movable to partially block and adjust a size of said first opening to receive the canister through said first opening and said second opening.

13. The dispenser of claim 12, wherein said first member is adjustable for receiving a plurality of differently sized canisters.

14. The dispenser of claim 12, wherein said member is slidably connected to said base collar, and wherein said first member allows for selective access to said first opening.

15. The dispenser of claim 12, wherein said member is a disc having said second opening therethrough, said second opening coinciding with said first opening in a first position, said disc covering said first opening in a second position, said second opening permitting an amount of access to said first opening in a third intermediate position.

16. The dispenser of claim 15, wherein said disc is biased to said base collar.

17. The dispenser of claim 15, wherein said disc is a actuated by a knob connected to said disc.

18. The dispenser of claim 17, wherein said knob is located in a notch in said base collar.

19. The dispenser of claim 13, wherein said base collar is adjusted vertically relative to said housing from a first elevated position to a second position lower relative to said first elevated position.

20. The dispenser of claim 12, further comprising a cap for connection to the dispenser, said cap having a member connected to said inlet port for preventing the foam and the liquid from escaping the dispenser.

21. A dispenser for removable connection to a canister, the dispenser comprising:

a housing having a chamber with an inlet port and an outlet port, said outlet port being on an exterior of the dispenser, said outlet port being connected to a nozzle to selectively release foam, said chamber being in contact with a heater for providing heat to the foam; and a base collar being connected to said housing by a device, said base collar having an opening, wherein said opening is adjustable, and wherein said device adjusts a distance between said base collar and said housing to receive a plurality of differently sized canisters.

22. The dispenser of claim 21, wherein said device has a threaded engagement to adjust between a first vertical position and a second vertical position.

23. The dispenser of claim 22, wherein said base collar has a disc with a second opening therethrough, said disc for selectively covering said opening to adjust a size of said opening, wherein said second opening has an inner edge with a grip portion for gripping a plurality of differently sized canisters.

24. A base collar for a dispenser comprising:

a housing having a top opening, a bottom opening with a notch, and a space therebetween;

a first adjustor being connected to the notch in said bottom opening, said first adjustor selectively covering said bottom opening in a first position, said first adjustor selectively allowing access to said bottom opening in a second position, said first adjustor being biased to said housing, said first adjustor being connected to a knob; and a second adjustor having a threaded engagement connected to an inner surface of said housing, wherein said first adjustor and said second adjustor selectively adjust said bottom opening to receive a plurality of differently sized foam canisters.

* * * * *